United States Patent [19]

Cupp

[11] Patent Number: 4,905,880

[45] Date of Patent: Mar. 6, 1990

[54] HOLSTER

[75] Inventor: Carl J. Cupp, Hawaiian Gardens, Calif.

[73] Assignee: Pachmayr Ltd., Monrovia, Calif.

[21] Appl. No.: 143,504

[22] Filed: Jan. 12, 1988

[51] Int. Cl.[4] ..... F41C 33/02; A45F 5/02

[52] U.S. Cl. ..... 224/192; 224/243; 224/253; 224/911

[58] Field of Search ..... 224/191, 192, 193, 198, 224/199, 200, 205, 206, 226, 231, 237, 238, 240, 243, 244, 246, 253, 904, 908, 911, 912, 913; 446/28, 401, 405, 473; 220/4 B

[56] References Cited

U.S. PATENT DOCUMENTS

| | | | |
|---|---|---|---|
| 3,379,349 | 4/1968 | Hier | 224/253 |
| 3,630,420 | 12/1971 | Bianchi | 224/911 |
| 4,143,798 | 3/1979 | Perkins | 224/243 |
| 4,298,150 | 11/1981 | Seldeen | 224/911 |
| 4,298,554 | 11/1981 | Vogel et al. | 220/4 B |
| 4,349,166 | 9/1982 | Tanaka et al. | 220/4 B |
| 4,466,585 | 8/1984 | Maehara | 220/4 B |
| 4,485,947 | 12/1984 | Cook . | |
| 4,485,948 | 12/1984 | Cook . | |
| 4,588,116 | 5/1986 | Litman | 224/253 |
| 4,620,654 | 11/1986 | Cook . | |

FOREIGN PATENT DOCUMENTS

| | | | |
|---|---|---|---|
| 2034668 | 6/1980 | United Kingdom | 220/4 B |

OTHER PUBLICATIONS

The literature of Monsanto Chemical Company entitled "A Phenomenal New Material", (Geolast).
Five pages of advertising literature "Sidekick".
Catalogue entitled "Bianchi".

*Primary Examiner*—Henry J. Recla
*Assistant Examiner*—Casey Jacyna
*Attorney, Agent, or Firm*—William P. Green

[57] ABSTRACT

A holster having a body molded of an elastomeric material, with that body being doubled back along a fold region essentially midway between two opposite edges of the molded body, and with those edges then being secured together by rivets or the like to define a gun receiving recess between front and rear panels of the holster. The rear panel contains a passage through which a belt extends for supporting the device from the belt. The two connected edges of the elastomeric body preferably have flanges projecting toward one another and connectable together, and which interfit to locate the flanges relative to one another. A gun may be retained in the holster by two flaps projecting upwardly from the front and rear panels and connectable together. The rear flap is preferably thicker and stiffer than the front flap, and desirably each of the flaps is slightly thicker and stiffer than the panel from which it projects upwardly. Internally, the panels may have inner ribs or projections shaped essentially in correspondence with a particular gun for which the holster is designed.

14 Claims, 6 Drawing Sheets

FIG. 1
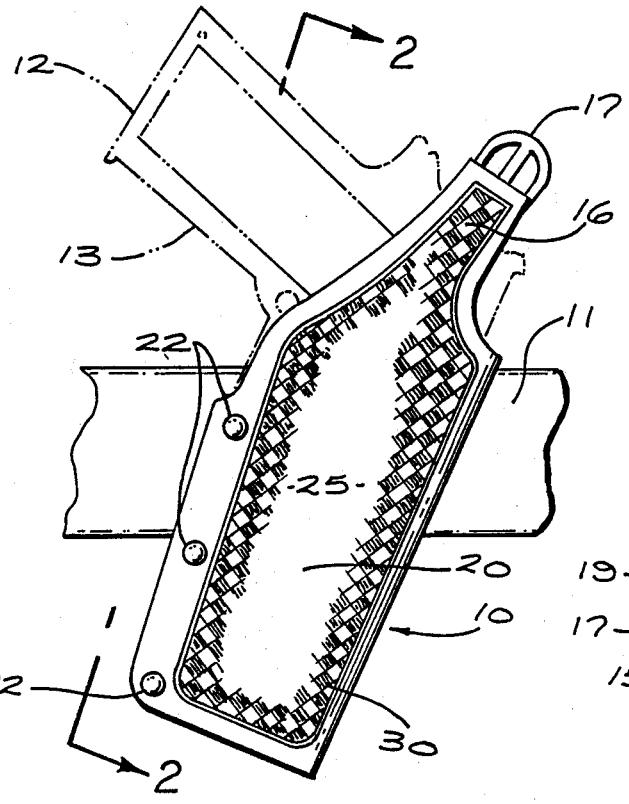
FIG. 2
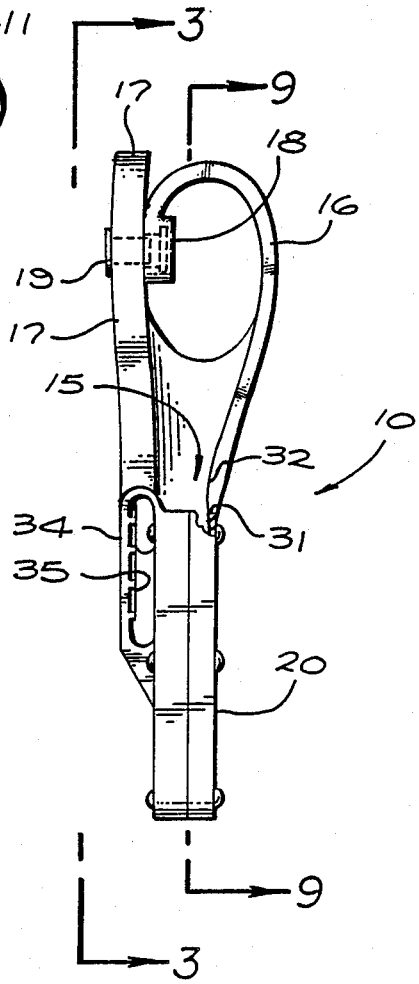
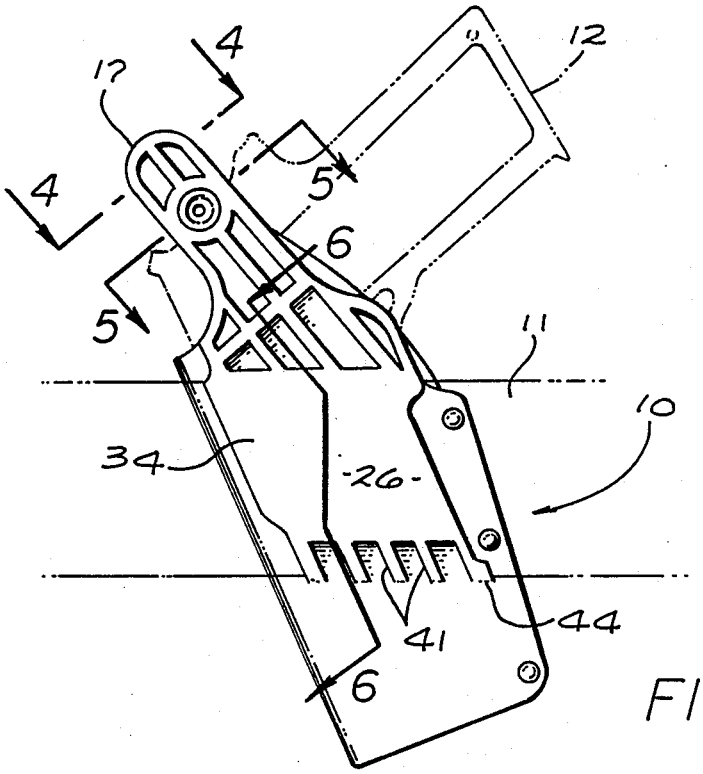
FIG. 3

FIG. 13
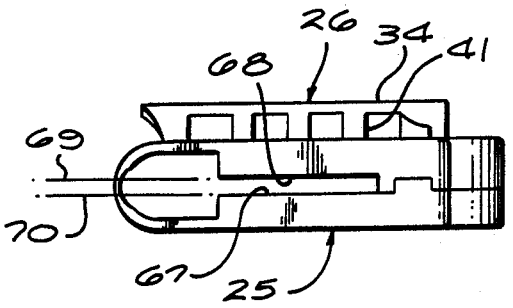
FIG. 14
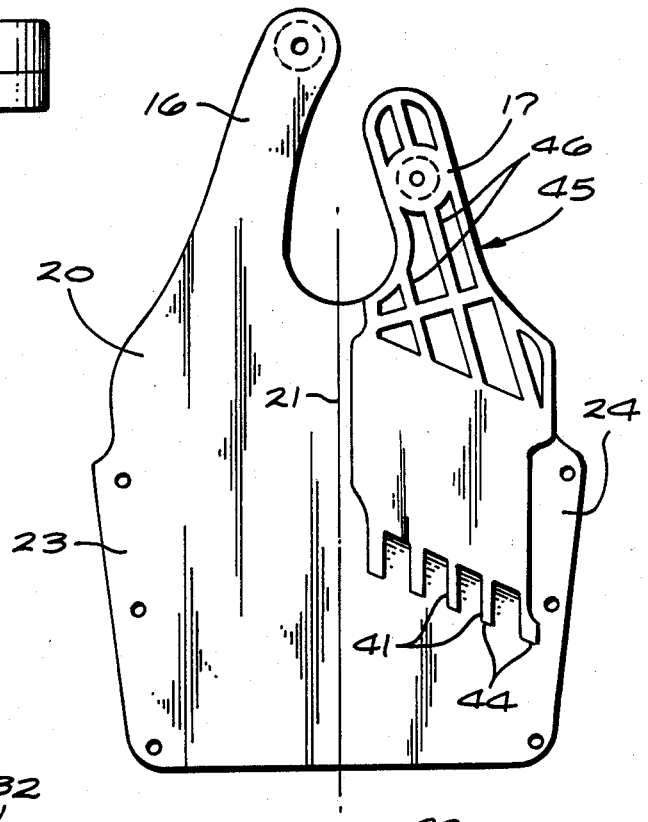
FIG. 15
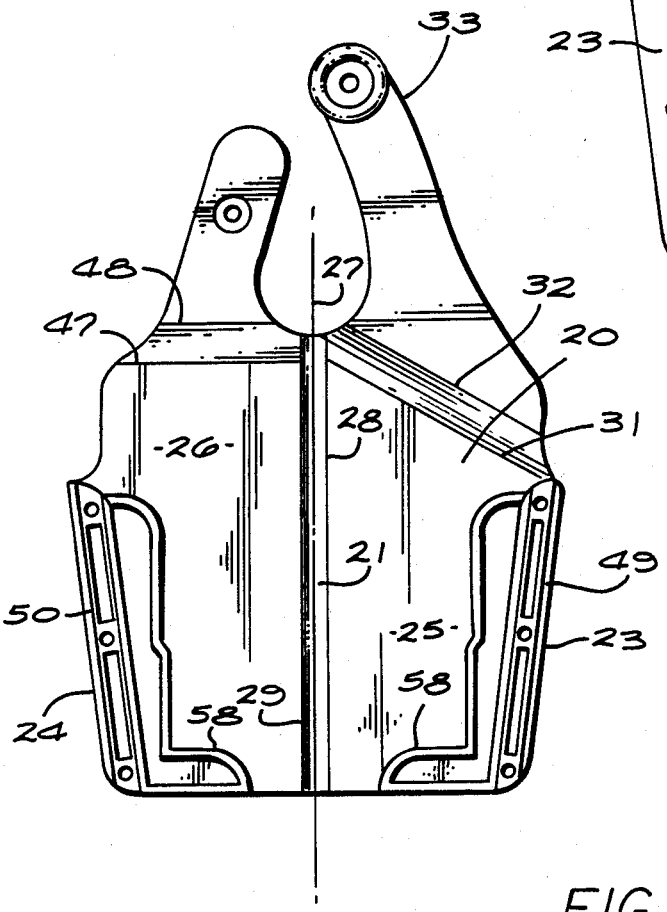
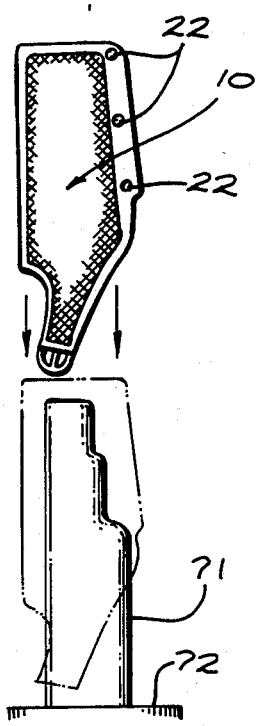
FIG. 16

HOLSTER

BACKGROUND OF THE INVENTION

This invention relates to improved holsters to be attached to the belt of a wearer and adapted to receive and support a pistol.

Most prior holsters have been formed of two or more pieces of leather appropriately stitched or otherwise secured together and in a desired shape. The main body of the holster is normally formed of a fairly large piece of leather doubled back to a folded condition and stitched along two of its edges to define an upwardly opening recess into which a gun is insertable. A second piece of leather may be stitched to an inner side or panel of the main body to form with that main body a passage through which a user's belt can extend to support the holster from the belt. Two flaps can project upwardly from the front and rear sides or panels of the holster, and be detachably connectable together by snap fasteners or the like in a condition retaining a gun within the holster.

A less expensive type of holster is shown in U.S. Pat. Nos. 4,485,947, 4,485,948 and 4,620,654, and includes two layers of fabric and an intermediate layer of polyethylene foam folded and stiched to a condition forming a gun receiving pocket recess. Such a holster, while lower in cost than a conventional leather holster, does not have the durability and strength of a leather holster and in many respects can not serve as effectively the intended gun receiving purpose.

SUMMARY OF THE INVENTION

A purpose of the present invention is to provide an improved holster which in virtually every respect is equal to or superior to a conventional leather holster, but which can be formed much more easily and less expensively than one made of leather. A holster embodying the invention can be shaped to very closely fit and receive a particular gun to be held in the holster, and will reliably retain its shape in use over a long period of time. The holster resists wear very effectively, either from external abrasion or from repeated insertion of a gun into the holster or removal therefrom. A gun can be positively retained in the holster, and yet easily removable when desired.

A holster formed in accordance with the invention may include a one piece body molded integrally of a suitable elastomeric material, preferably a thermoplastic elastomer easily shaped by injection molding equipment. The body may be initially formed in an open or flat condition, and then be double back at an intermediate fold region essentially midway between two opposite edges of the body to bring those edges together in a manner forming a gun receiving recess defined by and between a front panel of the elastomeric material and a rear panel. The rear panel has a portion which is thickened and contains a passage through which a user's belt can extend, to support the holster from the belt. The two mentioned edges of the body may be secured together by rivets or other means, with at least one of these edges having a flange projecting toward and connectable to the other edge to increase the rigidity of the holster body at the connected edges and space the panels apart. In the preferred arrangement, both of the edges have such flanges, projecting toward one another and desirably interfitting in a manner effectively locating the flanges in a desired optimal orientation with respect to one another. The interfitting relationship can be attained by providing a projection on one of the flanges extending into a recess in the other flange.

At their upper ends, the front and rear panels of the holster may have flaps formed integrally with the panels and detachably connectable together by a snap fastener or other means to hold a gun within the holster. The elastomeric material desirably is thickened at the locations of the flaps to increase their strength, and the flap of the rear panel is for best results substantially thicker and stiffer than the flap carried by the front panel.

Internally, the front and rear panels have projections or thickened regions near the interconnected edges of the elastomeric material and shaped to configuration somewhat different than the edges and corresponding essentially to the shape of a particular pistol to be inserted into the holster.

BRIEF DESCRIPTION OF THE DRAWINGS

The above and other features and objects of the invention will be better understood from the following detailed description of the typical embodiments illustrated in the accompanying drawings, in which:

FIG. 1 is an elevational view of a holster embodying the invention as seen from an outer or front side of the holster when supported on a wearer's belt;

FIG. 2 is a view taken on line 2—2 of FIG. 1;

FIG. 3 is an elevational view of the holster from its inner or back side;

FIG. 13 is a bottom view taken on line 13—13 of FIG. 9;

FIG. 14 is an elevational view of the elastomeric body of the device after it has been molded but before it has been folded or doubled to its final closed condition;

FIG. 15 is a view similar to FIG. 14, but showing the opposite or inner side of the molded body;

FIG. 16 is a somewhat diagrammatic representation illustrating the manner in which the molded body while still warm from the molding process can be placed over a forming element to more accurately define its shape;

DESCRIPTION OF THE PREFERRED EMBODIMENTS

Figure 4:
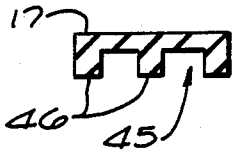
FIGS. 4 and 5 are transverse sections taken on lines 4—4 and 5—5 respectively of FIG. 3.
Figure 5:
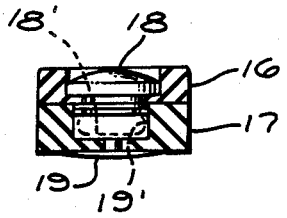

Referring first to FIGS. 1, 2 and 3, the holster 10 illustrated in those figures is adapted to be supported on the belt 11 of a user, and receives and holds a gun 12 which may be an automatic pistol having a handle portion 13 and a barrel portion 14 which projects downwardly into a pocket recess 15 and can be retained in that recess by two front and rear flaps or straps 16 and 17 detachably connectable to one another by snap fastener elements 18 and 19.

The main body 20 of the holster is molded of a material having some deformability, but also having sufficient stiffness to essentially maintain the shape to which it is molded and to tend to return to that shape when forcibly deformed. The material of body 20 is preferably a resiliently deformable elastomeric material which can initially be molded to the generally flat or open condition represented in FIGS. 14 and 15 and after molding can be folded or doubled back along a central fold region 21 to the final condition represented in FIGS. 1 to 3, and be retained in that doubled condition by rivets 22 or other fasteners. The fold region 21 is midway between two opposite edges 23 and 24 of the molded blank, and in the final folded condition of FIGS. 1 to 3 those edges 23 and 24 are brought together and secured to one another by the rivets 22. The portion of the molded body between fold region 21 and edge 23 forms a front panel 25 of the finished holster, and the portion of the body between fold region 21 and edge 24 forms a rear panel 26 of the holster, with the gun receiving pocket recess being formed between these two panels. Flaps 16 and 17 are integral with and project upwardly from the front and rear panels 25 and 26 respectively.

The material of body 20 is preferably a resiliently deformable elastomeric material, desirably having a Shore hardness between about 60 and 80, preferably about 70, on the A scale. For best results, the elastomeric material of body 10 should be thermoplastic, so that it can be molded rapidly and quickly in conventional injection molding equipment. The presently preferred molding compound for use in producing body 20 is the elastomeric material sold by Monsanto Chemical Company of 260 Springside Drive, Akron, Ohio as "Geolast". This substance is a composite elastomer which processes as a thermoplastic but has characteristics of a thermoset rubber. The composite molding substance includes fully cured rubber particles dispersed evenly throughout a continuous thermoplastic matrix. Upon heating, the matrix material melts giving the overall composition its thermoplastic molding characteristics without affecting the capacity of the fully vulcanized cured rubber particles to give the ultimate molded product the structural and functional advantages of a thermoset elastomeric material.

Figure 10:
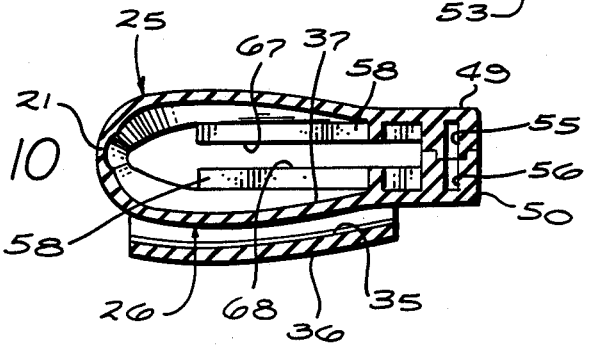
Figure 17:
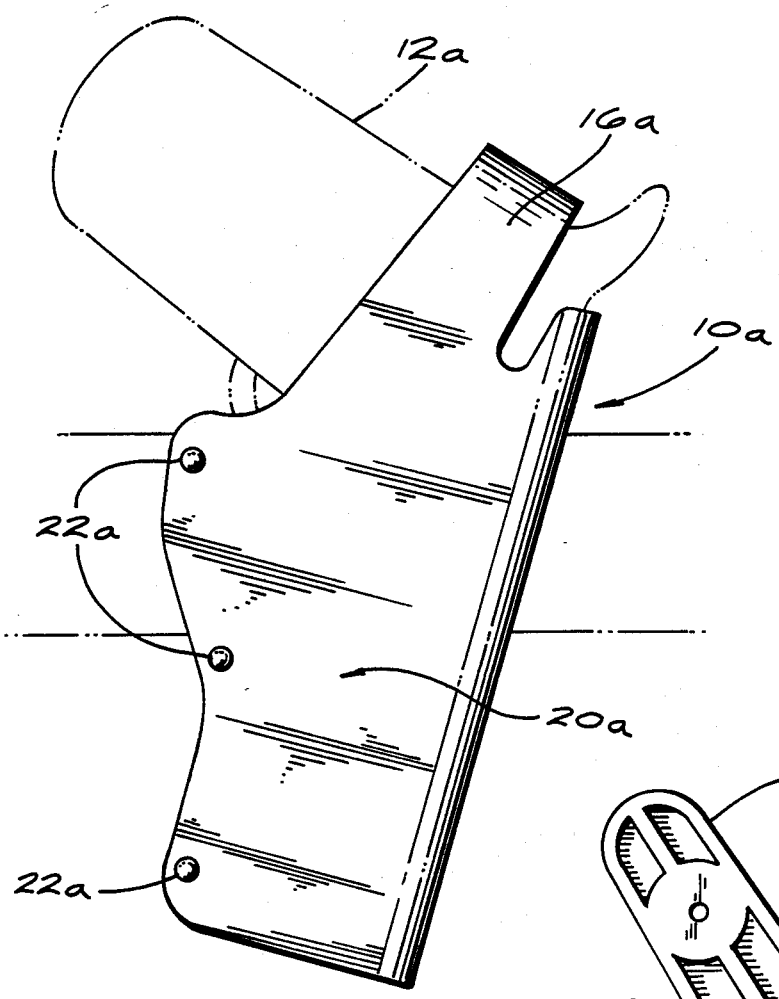
FIG. 17 is a front elevational view, similar to FIG. 1, of a variational form of holster embodying the invention and especially designed for holding a revolver.
Figure 18:
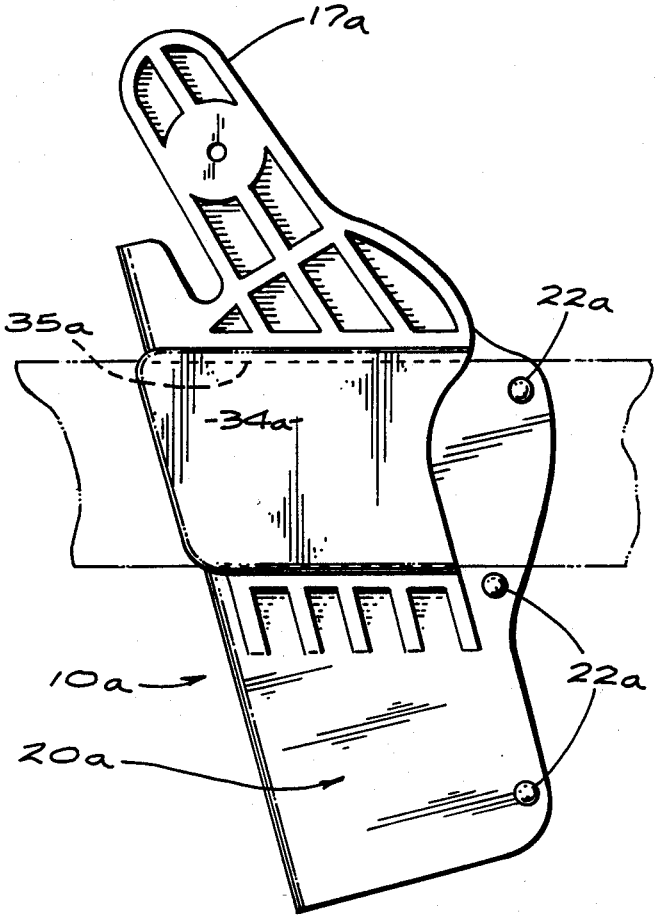
FIG. 18 is an elevational view of the back side of the holster of FIG. 17.

The portion of the elastomeric material of body 20 which extends along fold region 21 is thinner than the remainder of the body (see FIG. 10), including its front and rear panels 25 and 26, to facilitate deformation of the fold region 21 to the curved condition illustrated in FIG. 10. This reduced thickness fold region 21 is elongated as seen in FIG. 15. The material at fold region 21 may have a minimum thickness along a center line 27 (FIG. 15), and may increase gradually in thickness in opposite directions from that center line 21 to two parallel lines 28 and 29 at which the thickness corresponds to and merges with that of the front and rear panels.

Front panel 25 may be molded to present a three dimensional decorative pattern at its outer side, such as the basket weave illustrated at 30 in FIG. 1. This basket weave pattern may continue upwardly along a portion of the flexible flap or strap 16 which projects upwardly from panel 25. The thickness of flap 16 is desirably slightly greater than the thickness of the main portion of front panel 25, with the increase in thickness commencing at a line 31 (FIG. 15) extending at an inclination upwardly and leftwardly as viewed in FIG. 15. The thickness of the elastomeric material progressively increases in advancing upwardly from the line 31 to a parallel line 32, and then maintains a uniform thickness from the line 32 to the upper extremity 33 of flap 16. This increased thickness gives the flap slightly greater strength and stiffness than the remainder of the front panel.

Figure 6:
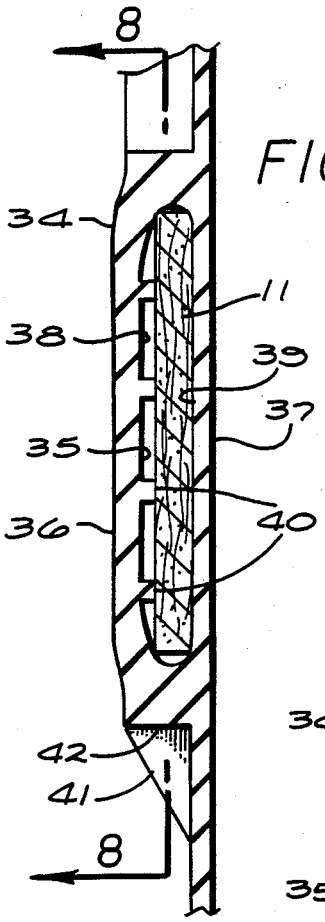
FIG. 6 is an enlarged fragmentary section taken on line 6—6 of FIG. 3.
Figure 7:
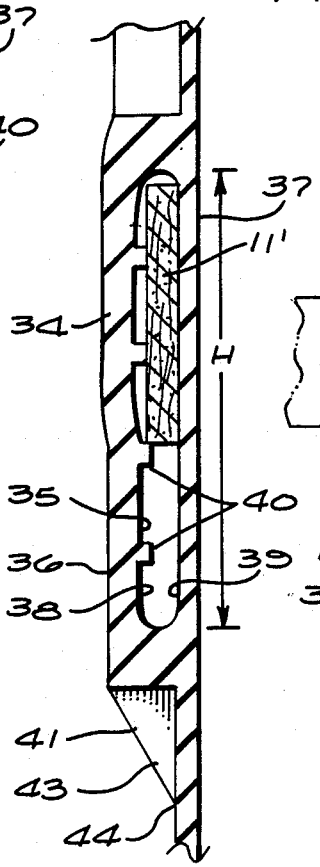
FIG. 7 is a view similar to FIG. 6, but showing the device as used with a belt which is not as wide as that of FIGS. 1 to 6.
Figure 8:
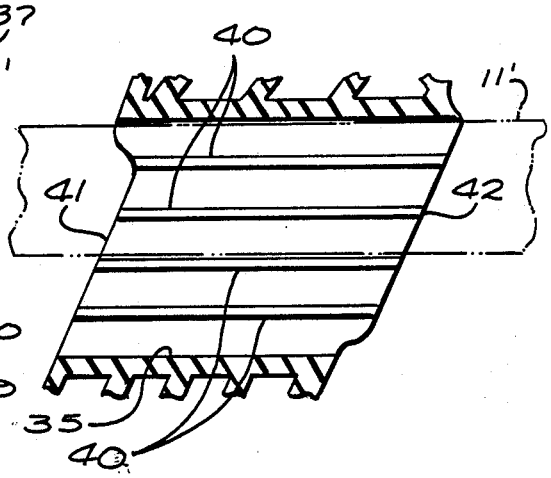
FIG. 8 is a reduced scale vertical section taken on line 8—8 of FIG. 6 and showing in broken lines the manner in which a narrow belt may be located within the belt receiving passage of the device.

The back panel 26 of the holster has a rearwardly thickened portion 34, as seen in FIG. 2, 3, 6 and 7, containing a passage or slot 35 for receiving the belt 11 from which the holster is to be suspended. Thickened portion 34 of the rear panel of the elastomeric body is defined at its back side by a surface 36 which in the initial FIG. 15 condition of the elastomeric body is planar and parallel to the front planar surface 37 of panel 26. The belt receiving passage 35 is defined by two surfaces 38 and 39 which are normally parallel to one another and to surfaces 36 and 37, when the belt is not present in passage 35, and which extend essentially vertically when the holster is in use. In accordance with the invention, the surface 38 defining the back of the belt receiving passage has a number of projections 40 formed integrally with the remainder of the elastomeric body and projecting forwardly therefrom toward the belt and toward surface 39 as seen best in FIG. 6. These projections desirably take the form of a series of similar horizontally extending vertically spaced parallel ribs, which preferably have the cross sectional configuration shown in FIG. 6, with parallel horizontal top and bottom surfaces 140 and vertical end surfaces 240. The projections may have that cross section uniformly along their entire horizontal extents between the opposite ends 41 and 42 (FIG. 8) of thickened portion 34 of the body and the contained passage 35. If the belt 11 with which the holster is utilized has a vertical extent as great as the height of passage 35, the belt extends from the top to the bottom of that passage and is engaged at its back side by projections 40. If, however, the device is utilized with a belt which is narrower vertically, that is, has a vertical extent less than the height H of the belt passage, such as is true for example of the belt typically illustrated at 11' in FIGS. 7 and 8, one or more of the projections 40 can engage the top and/or bottom of the belt in a manner locating the holster against vertical movement relative to the belt and thus maintaining the holster in fixed position on and relative to the belt. In FIGS. 7 and 8, one of the ribs or projections 40 is received beneath and is engageable with the bottom edge of belt 11', and thus prevents upward movement of the holster relative to the belt. Tightening of the belt deforms the holster slightly as illustrated, in a manner assuring that the projection 40 at the bottom of the belt will project outwardly beneath the belt in locating relation. In other instances, one of the projections 40 may engage the upper edge of the belt to prevent downward movement of the holster relative to the belt, or different ones of the projections may engage both of the upper and lower edges of the belt to confine it against relative movement. For any size belt, one or more of the projections 40 located above the bottom of passage 35 and beneath the top of that passage will be positioned to engage the top or bottom of the belt and assist in preventing relative motion of the belt and holster as described.

At the underside of the thickened belt loop portion 34 of the rear panel of the holster, the elastomeric material of the body and rear panel may be molded to form a series of horizontally spaced parallel strengthening webs or walls 41, which may have the triangular configuration illustrated in FIG. 6, with each of the webs 41 being integrally connected to the thickened portion 34 of the rear panel at 42, and being integrally connected to the lower thinner portion 43 of the rear panel at 44. Flap 17 formed at the top of rear panel 26 is thicker and therefore stiffer and stronger than front flap 16. Also, the rear flap 17 is shorter vertically than front flap 16, so that in the gun retaining condition, the longer and thinner and more flexible flap 16 can easily be curved to the locking position of FIG. 2 in which element 18 can be snapped into engagement with element 19 of the rear flap and be retained in the FIG. 2 condition. The extra thickness of the rear flap prevents excessive deformation of that flap as the front flap 16 is connected thereto or as it is detached therefrom. The fastener elements 18 and 19 may be conventional snap fastener parts as shown, with element 18 having a projection 18' which is slightly oversize with respect to a recess 19' in element 19 to be forcibly insertable thereinto and retained resiliently therein until forced away from element 19. At its rear side, the upper portion of rear panel 26 and flap 17 connected thereto may contain recesses 45 in a pattern such as that illustrated, with ribs or walls 46 located between and defining the recesses to give flap 17 and the upper portion of the rear panel the desired increased stiffness and strength while at the same time minimizing the weight of the holster at that location and assuring against excessive thickness of the molded material at any point. Above a location 47 at the lower end of flap 17 (FIG. 15), the thickness of the rear panel and its flap may increase slightly, from the line 47 of FIG. 15 to a line 48, and then have a uniform slightly increased thickness above the line 48, to further strengthen and stiffen flap 17. This thickening between the locations 47 and 48, and the previously mentioned thickening between the lines 31 and 32 of FIG. 15, occur at the inner sides of the flaps (the sides which face one another in the FIG. 2 assembled condition of the holster). As seen in FIG. 6, the front surface of rear panel 26 has a planar vertical portion 37 up to the line 47, and then advances gradually rightwardly in FIG. 6 to the line 48. Above the line 48 and to the top of flap 17, the front surface of rear panel 26 has a planar vertical portion 37' offset slightly rightwardly with respect to the lower surface area 37. Surface 36 at the back of rear panel 26 may normally (when not deformed by the presence of a belt in passage 35) be planar and vertical from the lower end 136 of the thickened belt receiving portion of panel 26 to the upper extremity of flap 17, except at the locations of recesses 45 and fasteners 18 and 19.

Figure 9:
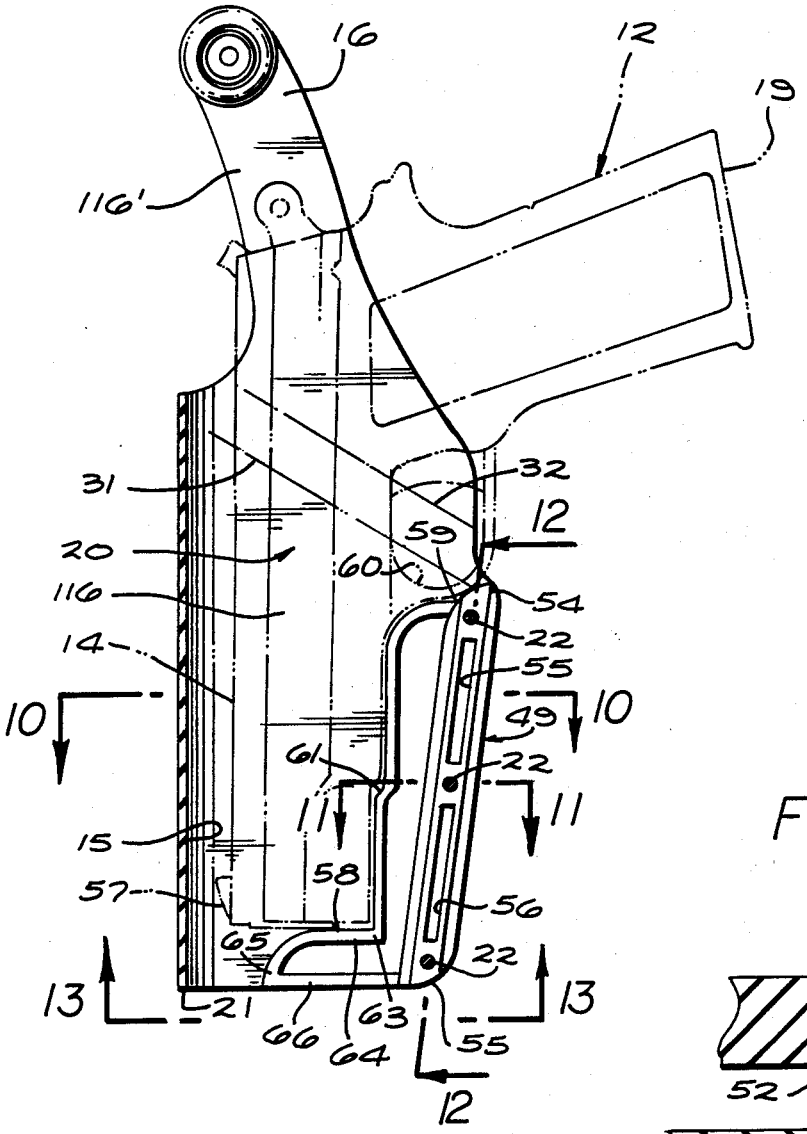
FIG. 9 is a section taken on line 9—9 of FIG. 2.
Figure 12:
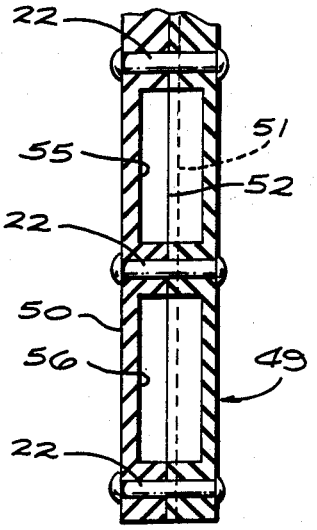
FIGS. 10, 11 and 12 are sections taken on lines 10—10, 11—11 and 12—12, respectively, of FIG. 9.

When flap 16 is in its normal upwardly projecting open position of FIG. 9, the inner surface 116 of the front panel and its flap 16 is vertical and planar up to line 31, then advances gradually toward the rear panel to line 32 to thicken the flap, and then is again planar and vertical to maintain that increased thickness up to the end of the flap.

Figure 11:
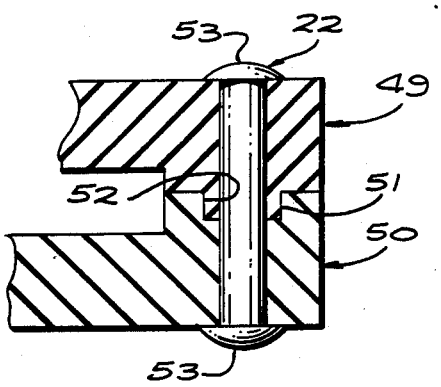

Along the two edges 24 and 25 of the elastomeric holster body which are secured together by rivets 22, the body is molded to form two elongated flanges 49 and 50 at which the thickness of the panels is greater than it is adjacent those flanges, so that when the body is folded to the condition of FIGS. 1 to 3 the flanges 49 and 50 project toward one another and engage one another as seen in FIGS. 10 through 13, to hold the front and rear panels in spaced relation and stiffen the panels and holster at those connected edge locations. Flanges 49 and 50 are given cross sections which interfit with one another when the flanges are brought together and retained together by rivets 22. More specifically, as seen for example in FIG. 11, flange 49 has an elongated projection 51 which may have the essentially rectangular cross section illustrated in FIG. 11 and which projects into a recess or groove 52 of corresponding rectangular cross section formed in flange 50 to effectively locate the flanges against relative displacement. At the location at which FIG. 11 is taken, one of the rivets 22 extends through registering passages in the two flanges, with the heads 53 at opposite ends of the rivet bearing against the flanged edge portions of the panels and holding them tightly together as shown. The interfitting projection 51 and groove 52 have the cross section illustrated in FIG. 11 along their entire extent between locations 54 and 55 of FIG. 9, except as that cross section is varied to receive the three rivets 22 at spaced locations and to provide elongated lightening recesses 55 and 56 between the rivets. These recesses 55 and 56 may have the rectangular transverse sectional configuration illustrated in FIG. 10, and the rectangular longitudinal sectional configuration illustrated in FIG. 12.

When the barrel of a gun is inserted into the holster, the top of the barrel and its forward sight 57 (FIG. 9) are received near the fold region 21 of the elastomeric holster body. At the opposite side of the gun receiving pocket, (right side in FIG. 9), the front and rear panels are shaped to provide walls or projections 58 near the two flanges 49 and 50 and corresponding essentially in outline configuration to the shape of the engaged portion of the gun, to thus give the interior of the holster a shape closely fitting and effectively holding and locating the gun barrel. More particularly, if the gun is a Browning Hi-Power automatic pistol as represented generally in the drawings, walls or projections 58 on the two panels may both have the shape illustrated in FIG. 9. In extending from the location 59 of FIG. 9, wall 58 may curve first leftwardly and then downwardly to fit the curvature of the gun adjacent its trigger loop 60, with the wall then extending essentially straight to a location 61 at which the wall may be offset slightly to the left in FIG. 9, after which the wall extends downwardly along an essentially straight line to a point 63, at which it extends leftwardly at 64, then downwardly at 65, and then rightwardly at 66 across the bottom of the holster. The portion 64-65-66 at the bottom of the holster engages the end of the barrel to support it as shown.

Each of the walls or projections 58 of the holster projects from the front or rear panel of the holster in the same direction that the flange 49 or 50 of that panel projects, but the walls 58 preferably do not project as far as the flanges, and as a result the walls 58 of the two panels desirably do not engage one another but are spaced apart as illustrated in FIGS. 10 and 13. The inner edges or surfaces 67 and 68 of the two walls 58 may lie in planes 69 and 70 (FIG. 13) which are spaced apart as shown.

FIG. 16 represents the manner in which holster 10 may be preformed to more closely fit a gun with which it is to be utilized. In FIG. 16 there is represented at 71 a forming element preferably made of steel or other metal which is attached to and projects upwardly from a rigid support 72 and which has a shape corresponding very closely to the barrel of the gun with which holster 10 is intended to be utilized. During manufacture, the elastomeric material from which the holster is formed is heated to a temperature above the ambient atmospheric temperature, high enough to melt the elastomeric material, and in that melted condition the material is injected into a mold and shaped thereby to the flat or open condition represented in FIGS. 14 and 15. The item is then removed from the mold, and while still substantially above ambient temperature from the injection molding process is folded to a closed condition such as that represented in FIG. 1 and retained in that condition by rivets 22. In that closed condition and while still heated substantially above the ambient atmosphere temperature, the holster is then inverted and moved downwardly over the forming element 71 of FIG. 16, to force that element into the interior of the holster and to a position corresponding to that in which the gun barrel will ultimately be received in use of the holster. The element 71 is dimensioned to force the front and rear panels of the holster slightly farther apart than they normally may be after the molding and riveting procedure, with the elastomeric material then being permitted to cool to ambient temperature while on the forming element 71 so that the ultimate product will take a set in exactly the right configuration for reception of the gun barrel. Snap fastener elements 18 and 19 are attached to the flaps 16 and 17 at any convenient stage during the manufacturing process.

The holster is utilized in essentially the same way as any conventional holster. Flap 16 can be detached from flap 17 by the user's thumb, leaving the gun easily accessible for removal from the holster body. The material of the body effectively retains its illustrated shape over long periods of use, presents a very attractive appearance, and can withstand wear very effectively.

Figure 19:
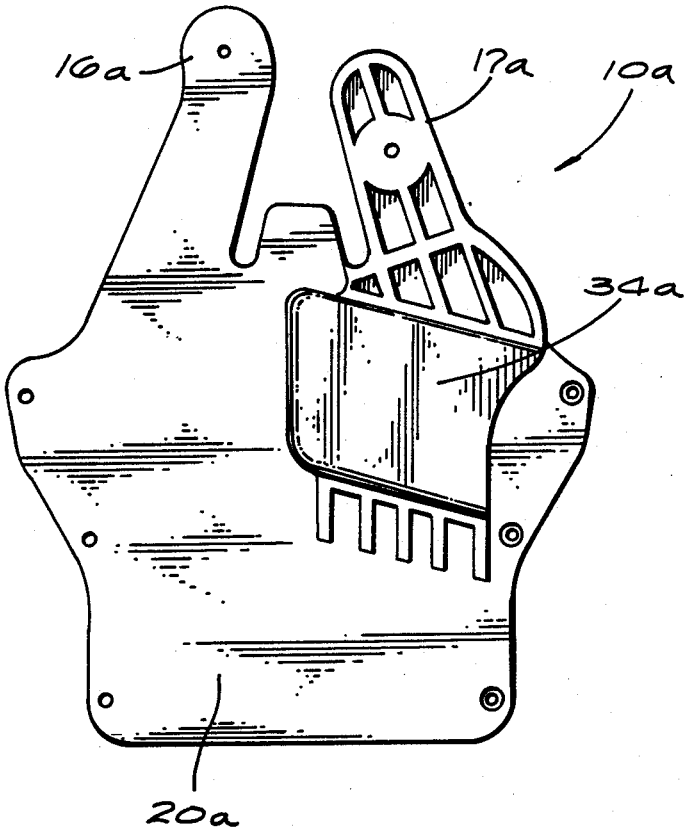
FIG. 19 is a view showing the outer side of the elastomeric body of the holster of FIG. 17 before the body is folded or doubled to its final condition.
Figure 20:
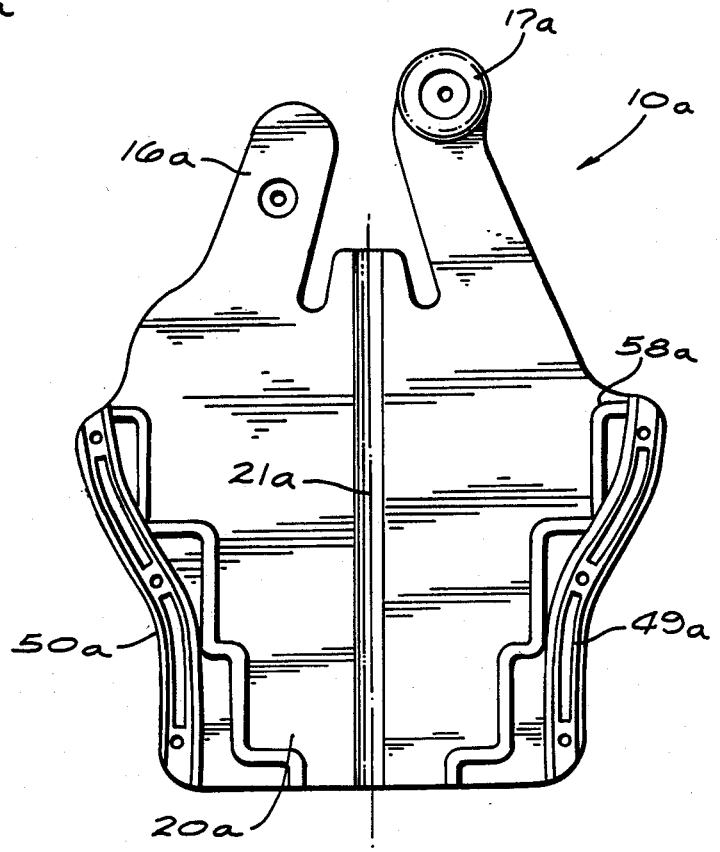
FIG. 20 shows the inner side of the elastomeric body before being folded.

FIGS. 17 through 20 show a variational form of holster 10*a* which is very similar to that of FIGS. 1 through 16 but is intended for use with a revolver 12*a* rather than the automatic pistol of FIG. 1. FIGS. 17, 18, 19 and 20 correspond essentially to FIGS. 1, 3, 14 and 15, with appropriate changes in shape of the elastomeric body of the device to receive a revolver. As in the first form of the invention, the elastomeric body 20*a* is initially molded in a flattened or open condition as seen in FIGS. 19 and 20, with interfitting flanges 49*a* and 50*a* being provided along opposite edges but being shaped as shown to allow for reception of a revolver in the final product. The body is doubled at fold line 21*a*, and the two flanges 49*a* and 50*a* are secured together by rivets 22*a*. Projections or walls 58*a* near flanges 49*a* and 59*a* are similar to projections 58 of the first form of the invention, but are shaped differently as shown to follow the contours of a particular revolver and thereby shape the holster internally to fit that revolver rather closely. As in the first form of the invention, the projections 58*a* of the front and rear panels preferably do not contact one another in the finished holster.

Thickened portion 34*a* of the rear panel 26*a* contains a belt receiving passage 35*a* having ribs corresponding to those illustrated at 40 in FIGS. 6, 7 and 8 for retaining the holster in fixed orientation relative to a belt such as that shown in FIG. 7 having a vertical extent less than the height of passage 35*a*. Flaps 16*a* and 17*a* serve the same function as flaps 16 and 17 of the first form of the invention, with the rear flap 17*a* being thicker than flap 16*a* in correspondence with the first form. Other features of the second form are carried over from the first form of the invention, and will not be discussed in detail.

While certain specific embodiments of the present invention have been disclosed as typical, the invention is of course not limited to these particular forms, but rather is applicable broadly to all such variations as fall within the scope of the appended claims.

I claim:

1. A holster comprising:

a holster body adapted to support an article from either a first relatively narrow belt or a second wider belt, each of which belts has vertical outer and inner surfaces and horizontal top and bottom edges, with said top and bottom edges of the narrow belt being closer together than the top and bottom edges of the wider belt;

said body containing a passage through which either of said belts can be inserted horizontally;

said body having outer and inner walls defining outer and inner sides of said passage to be received opposite said vertical surfaces of the belts;

at least one of said walls being flexible for movement slightly toward and away from the other wall;

said at least one of said walls having at least one projection extending therefrom toward the second wall at a location beneath the top of said passage and above the bottom of said passage and which is constructed and positioned with respect to said at least one of said walls to be received vertically beyond said narrow belt when said narrow belt is inserted through the passage, and to engage vertically against one of said top and bottom edges of the narrow belt by said movement of said at least one of said walls and thereby restrict movement of said holster body relative thereto;

said projection being constructed and dimensioned to permit insertion of said wider belt into and entirely through said passage and past said projection, with the projection engaging laterally against one of said vertical surfaces of the wider belt at a location between said top and bottom edges thereof and in a relation deflecting said outer and inner walls of the holster body slightly apart to pass the belt through the passage.

2. A holster as recited in claim 1, in which said projection projects from the wall by which it is carried a distance less than the horizontal thickness of each of said belts.

3. A holster as defined in claim 1, in which said projection is a rib which is elongated generally horizontally within said passage.

4. A holster as recited in claim 1, in which said projection is an elongated rib extending generally horizontally between opposite ends of the passage, the wall from which said rib projects having essentially vertical surfaces directly above and beneath said rib and beyond which said rib projects toward said second wall.

5. A holster as recited in claim 1, in which there are a plurality of said projections extending from one of said walls at vertically spaced locations, for engaging vertically against belts of a plurality of different widths narrower than said wider belt, and all of which projections are constructed and dimensioned to permit insertion of said wider belt therepast through said passage, with all of the projections engaging laterally against the wider belt between its top and bottom edges to deflect said inner and outer walls of the holster body apart at each of said projections.

6. A holster as recited in claim 1, in which there are a plurality of said projections comprising a series of elongated ribs formed on one of said walls and projecting therefrom toward said second wall at vertically spaced locations, with said ribs extending generally horizontally and essentially parallel to one another.

7. A holster as recited in claim 6, in which each of said ribs projects from the wall by which it is carried a distance less than the horizontal thickness of each of said belts.

8. A holster as recited in claim 7, in which said outer and inner walls of said body are integrally and permanently connected together both above and beneath said passage.

9. A holster as recited in claim 1, in which said outer and inner walls of said body are integrally and permanently connected together both above and beneath said passage.

10. A holster comprising:

a body molded of a flexible material and double back at a fold region approximately midway between two edges of the body to form a front panel and a rear panel defining a recess therebetween into which a gun is insertible;

said rear panel being connectible to a user's belt to support the holster therefrom;

said body having an elongated flange molded integrally with one of said panels and extending along one of said two edges of the body and which projects inwardly from said one panel toward the other edge of the body;

means securing said flange to said outer edge to retain the body in double condition;

said one panel having an elongated projection extending toward the other panel near said flange and spaced therefrom at at least some locations, and which projection is elongated generally parallel to said flange but has a configuration different than said flange defining a side of said gun receiving recess shaped generally complimentally to the shape of a predetermined gun to be located in the holster.

11. A holster as recited in claim 10, in which said elongated projection has a portion which extends away from said flange at a location to engage an end of a gun and limit insertion thereof into the holster.

12. A holster comprising:

a body molded of a flexible material and doubled back at a fold region approximately midway between two edges of the body to form a front panel and a rear panel defining a recess therebetween into which a gun is insertible;

said rear panel being connectible to a user's belt to support the holster therefrom;

said body having two elongated flanges molded integrally with said front and rear panels respectively and extending along said two edges respectively of the body and each of which projects inwardly from a corresponding one of the panels toward the other flange carried by the other panel;

means securing said flanges together to retain the body in doubled condition;

said two panels having similar elongated projections formed on the panels near said two flanges respectively and spaced therefrom at at least some locations and each of which projections is elongated generally parallel to a corresponding one of the flanges but has a configuration different than said corresponding flange defining a side of said recess in the holster shaped essentially complimentarily to the shape of a gun to be located in the holster.

13. A holster as recited in claim 12, in which said elongated projections project toward one another but are spaced apart.

14. A holster as recited in claim 13, in which said elongated projections have portions which extend away from the corresponding flanges at locations to engage the end of a gun and limit insertion thereof into the holster.

* * * * *